US005244198A

United States Patent [19]

Green

[11] Patent Number: 5,244,198

[45] Date of Patent: Sep. 14, 1993

[54] GATE FORMING MEMBER FOR SHEET FEEDING APPARATUS

[76] Inventor: Ronald J. Green, E11412B N. Reedsburg Rd., Baraboo, Wis. 53913

[21] Appl. No.: 874,827

[22] Filed: Apr. 28, 1992

[51] Int. Cl.[5] ..... B65H 3/52

[52] U.S. Cl. ..... 271/125; 271/35; 271/121

[58] Field of Search ..... 271/121, 122, 124, 125, 271/24, 35

[56] References Cited

U.S. PATENT DOCUMENTS

| | | | |
|---|---|---|---|
| 4,216,952 | 8/1980 | McInerny | 271/122 X |
| 4,437,658 | 3/1984 | McInerny | 271/125 |
| 4,500,084 | 2/1985 | McInerny | 271/122 X |
| 4,991,831 | 2/1991 | Green . | |

FOREIGN PATENT DOCUMENTS

| | | | |
|---|---|---|---|
| 33331 | 4/1981 | Japan | 271/121 |

*Primary Examiner*—Robert P. Olszewski
*Assistant Examiner*—Boris Milef
*Attorney, Agent, or Firm*—Bell, Seltzer, Park & Gibson

[57] ABSTRACT

A sheet feeding apparatus is disclosed which includes a gate forming member composed of a pair of rolls disposed in a parallel, laterally adjacent relationship. The first roll defines the nip of the sheet feeding apparatus, and each of the rolls includes a plurality of annular grooves. The rolls are mounted with the annular grooves respectively aligned, and a ring of elastomeric material is mounted in each pair of aligned grooves so as to encompass the peripheral surfaces of the two rolls, and with and the grooves in the first roll being configured so that the rings are exposed at the nip. Upon rotation of the second roll, the rings may be moved with respect to the first roll, so that unworn portions of the rings may be moved to the nip.

20 Claims, 5 Drawing Sheets

GATE FORMING MEMBER FOR SHEET FEEDING APPARATUS

BACKGROUND OF THE INVENTION

The present invention relates to a gate forming member for use with an apparatus for serially feeding sheets of paper or the like from the bottom of a generally vertical stack of such sheets.

U.S. Pat. No. 4,991,831, issued to the named inventor of the present application, discloses a sheet feeding apparatus which includes a stationary gate forming member which defines a nip formed between the gate forming member and the upper run of the endless belt which feeds the sheets through the nip. The gate forming member comprises a cylindrical roll, and the roll includes a plurality of annular grooves which are eccentrically disposed with respect to the axis of the roll, and so that the groove is relatively deep along the side facing the stack of sheets, and relatively shallow along the opposite side. The transition between the relatively deep and relatively shallow portions of the grooves is located at the nip, and at a diametrically opposite location.

The roll of the referenced patent includes elastomeric rings disposed in each of the grooves, and the rings are sized so as to lie radially inside of the peripheral surface of the roll about the side facing the stack of sheets, and radially beyond the peripheral surface about the opposite side. This arrangement permits the rings to extend slightly beyond the peripheral surface at the nip. In operation, the gap formed by the nip is adjusted to allow the lowermost sheet of the stack to pass freely therethrough, and so that the sheet above the lowermost sheet frictionally engages the rings at the nip and is thereby retarded. When the lowermost sheet has been moved forwardly a sufficient distance to permit the overlying sheet to contact the endless drive belt, the overlying sheet is then driven forwardly into the nip to form a tight fit, and which in turn causes the sheets to be shingled as they are fed from the stack.

While the apparatus described in the referenced patent operates very reliably and efficiently, the elastomeric rings are subject to wear at the nip and become less effective. As suggested in the referenced patent, the rings may be grasped and rotated circumferentially, to position an unworn portion of each ring at the nip. Alternatively, the rings may be totally replaced.

It is an object of the present invention to provide an improved gate forming member for a sheet feeding apparatus of the described type, and which includes a simple and more efficient system for renewing the rings as they become worn at the nip.

SUMMARY OF THE INVENTION

The above and other objects and advantages of the present invention are achieved in the embodiment illustrated herein by the provision of a gate forming member which comprises a generally cylindrical first roll defining a central axis and including an outer peripheral surface, and a plurality of annular grooves extending about the circumference of the peripheral surface, and with the first roll positioned adjacent the forward side of the stack and so as to define a nip which forms a gap between the first roll and the upper run for permitting the lowermost sheet of the stack to pass forwardly from the stack through the nip. A generally cylindrical second roll is provided which defines a central axis and includes an outer peripheral surface, and a plurality of annular grooves extending about the circumference of the peripheral surface of the second roll. The first and second rolls are mounted in an adjacent parallel relationship and with the annular grooves of the first and second rolls being respectively aligned, and such that the second roll may be selectively rotated about its central axis, also, a ring of elastomeric material is mounted in each pair of aligned grooves and so as to be disposed along an endless path which encompasses the peripheral surfaces of the first and second rolls, whereby rotation of the second roll about its central axis facilitates movement of the rings along the endless path about the peripheral surfaces of the first and second rolls. Thus, an unworn portion of each ring may be positioned at the nip, and because of the circumferential length of the rings, this process may be repeated several times until all portions of the rings have been positioned at the nip.

In the preferred embodiment, the gate forming member further comprises locking means mounted to the second roll for selectively engaging the rings so as to prevent movement of the rings along the their respective grooves in the second roll during the rotation of the second roll about its central axis. This locking means may comprise a locking bar positioned to extend transversely across the peripheral surface of the second roll in a direction parallel to its central axis, and threaded means interconnecting the bar to the second roll so that the bar may be selectively moved between a first position wherein the bar is radially spaced from the rings and the bar may be freely moved along the circumference of the second roll, and a second position wherein the bar is drawn radially into engagement with the rings on the second roll. Thus during rotation of the second roll with the bar in its second position, the rings necessarily move with the rotation of the second roll and also move across the peripheral surface of the first roll, which preferably does not rotate about its axis.

BRIEF DESCRIPTION OF THE DRAWINGS

Some of the objects and advantages of the present invention having been stated, others will appear as the description proceeds, when taken in conjunction with the accompanying drawings in which.

DETAILED DESCRIPTION OF THE EMBODIMENT

Figure 1:
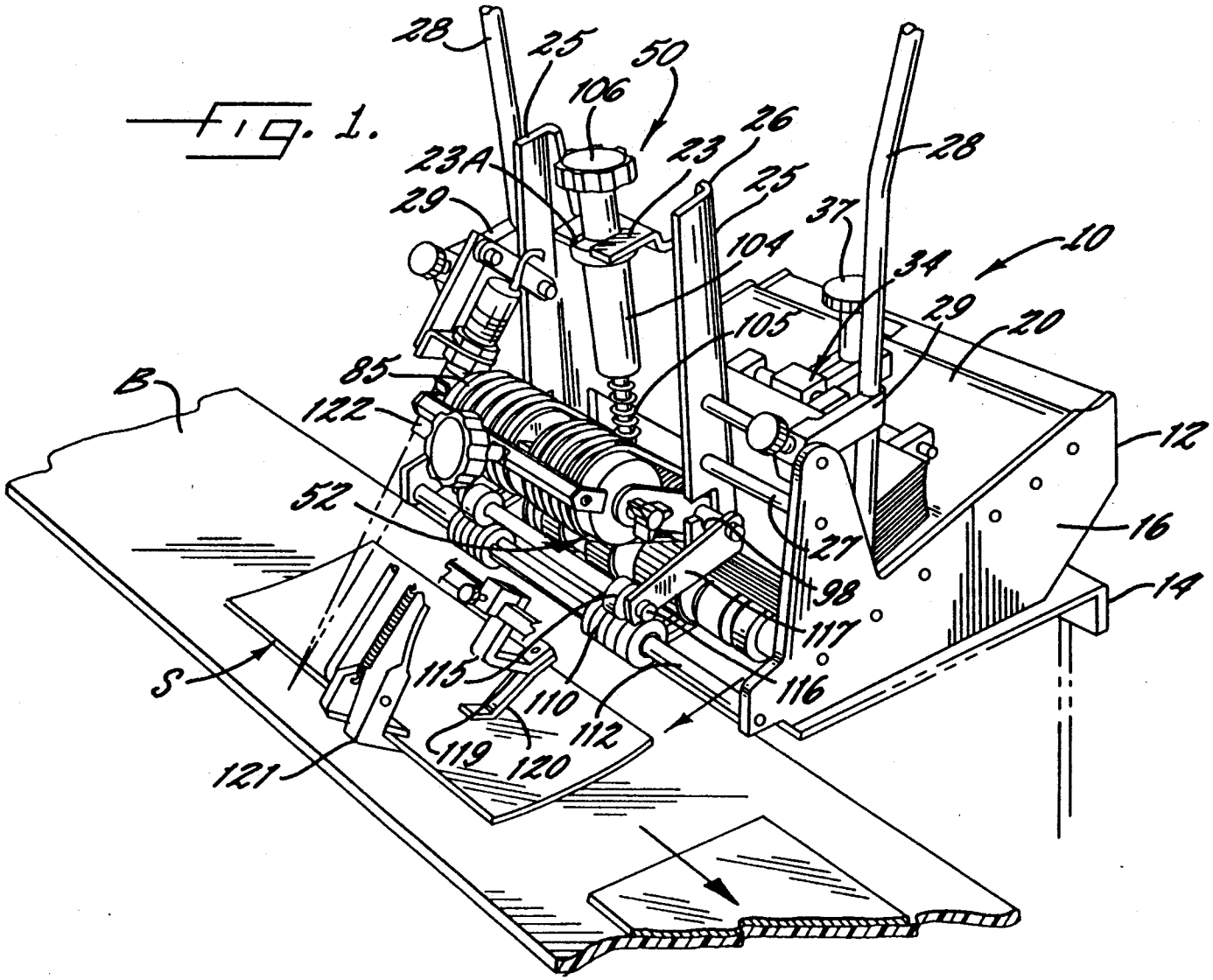
FIG. 1 is a perspective view of a sheet feeding apparatus which embodies the features of the present invention.

Referring more particularly to the drawings, an apparatus for serially feeding sheets of paper from a bottom of a generally vertically stack of such sheets, and which embodies the features of the present invention, is indicated generally at 10. The apparatus 10 is shown in use as a part of a sheet feeding system, and wherein the sheets S are fed laterally from the bottom of the stack onto a moving conveyor belt B, and so that the sheets may be subsequently collated with other sheets, or placed in mailing envelopes, in a conventional manner.

Several components of the apparatus 10 are illustrated in more detail in the above-referenced U.S. Pat. No. 4,991,831, and the disclosure thereof is expressly incorporated herein by reference.

The apparatus 10 comprises a rigid frame 12 which includes a base plate 14, a pair of upright side plates 16 which are joined to the base plate, and a number of transverse rods 18 extending between and interconnecting the side plates. The transverse rods 8A and 18B are mounted by means of bearings (not shown) to the side plates 16, so as to permit the free rotation thereof. The remaining transverse rods are fixedly mounted to the side plates. Also, the frame includes a rear cover plate 20 which extends between the side plates 16 and is connected thereto at the rear portion of the frame.

Figure 2:
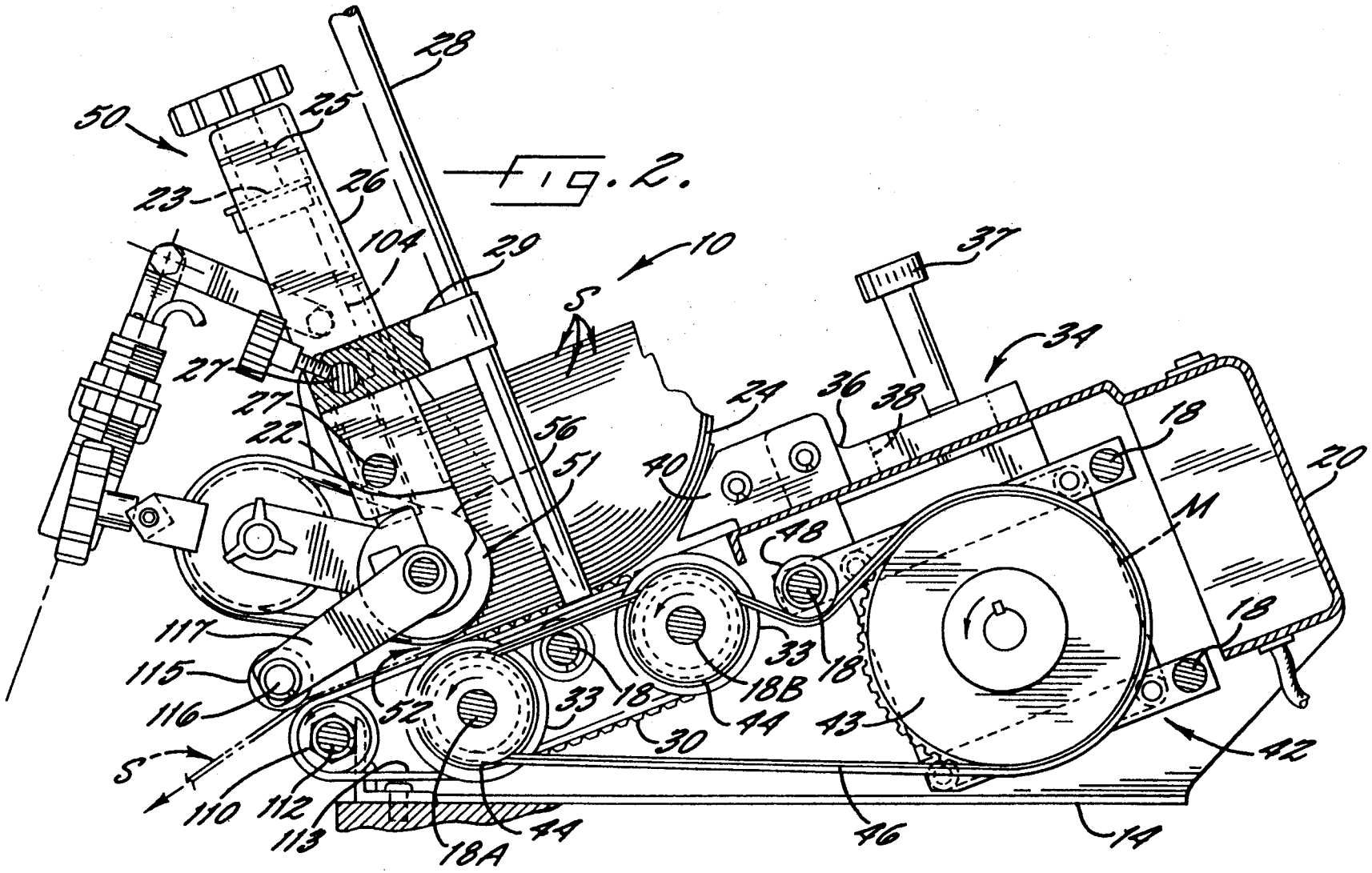
FIG. 2 is a sectional side elevation view of the apparatus.

The apparatus 10 further comprises means for supporting a generally vertical stack of rectangular sheets S of paper. As best seen in FIG. 2, the supported stack defines a forward side 22 composed of aligned forward edges of the sheets, as well as the opposite rear side 24 composed of the aligned rearward edges of the sheets. The forward side of the stack is supported in the forward direction by a generally vertically extending front support plate 26. The front support plate includes inturned opposite sides 25, which are fixedly secured to the frame by transverse rods 27. The upper portion of the support plate includes a generally horizontal mounting bracket 23 having a forwardly extending slot **23*a*** for the purposes described below.

The means for supporting the vertical stack of paper sheets also includes a pair of vertical rods 28 which support respective opposite ends of the stack, and the rods are each mounted to the frame by an arm 29 which is fixed to the associated vertical rod, and which is coupled to a transverse rod 27 by an opening which receives the transverse rod, and a threaded member, so as to permit the separation of the rods 28 to be laterally adjusted. Thus the rods are able to accommodate stacks of sheets of different length therebetween.

Figure 5:
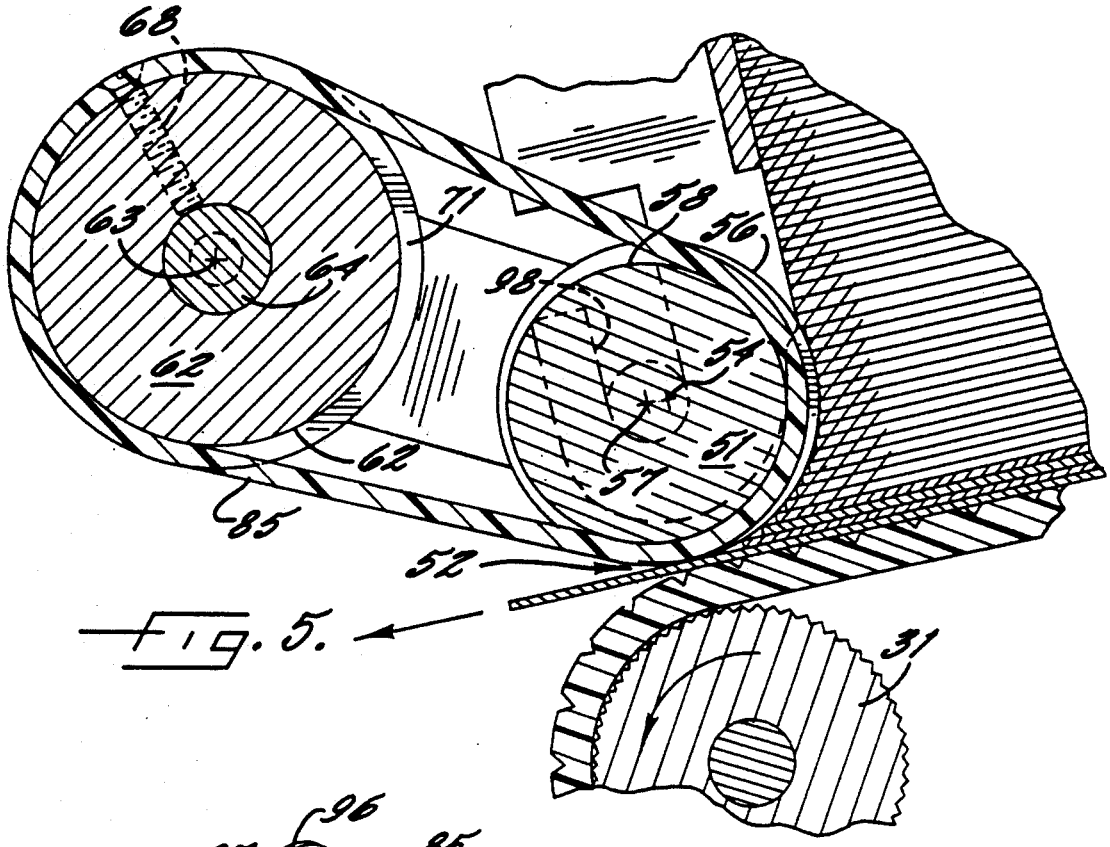
FIG. 5 is a fragmentary, sectional side elevational view of the gate forming member and adjacent portions of the apparatus.

The stack supporting means further includes endless belt means, and which comprises, in the illustrated embodiment, three endless belts 30, and a pair of aligned support rolls 31 (FIG. 5) mounted on respective ones of the support shafts 18A, 18B for mounting each of the endless belts. A plurality of drive rolls 33 (FIG. 2) are mounted on each of the support shafts 18A, 18B, with one of the drive rolls 33 being positioned on each shaft between adjacent endless belts 30. The diameter of the support rolls 31 is less than the diameter of the drive rolls 33 so that the drive rolls have an outer surface which is substantially coextensive with the outer surface of the endless belts 30. The support rolls 31 are positioned such that the three belts 30 define coplanar upper runs which extend across the bottom of the stack. The belts 30 bridge the space between the drive rollers 33, and the belts 30 and drive rollers 33 serve to convey the sheets forwardly to the nip area in the manner further described below.

The stack supporting means also includes a rear support member 34 which is positioned above the upper runs of the three belts and below the rear side of the stack of sheets. The rear support member includes a bracket 36 which is releasably connected to the rear cover plate 20 by means of a threaded member 37 which extends through a slot 38 in the bracket and which threadedly engages a selected one of three threaded openings (not shown) in the rear cover plate. The bracket also includes four forwardly extending fingers 40 which underlie the rear side of the stack of sheets. The fingers each have an inclined forward edge as best seen in FIG. 2, so as to lift the rear side of the stack upwardly from the upper run of the three belts. The lateral position of the bracket and the fingers is thereby adjustable so as to permit accommodation of sheets of differing widths.

The three belts 30 and drive rollers 33 are rotated by a drive system 42 so that the upper runs move in a right to left (or forward) direction as seen for example in FIG. 2. This drive system includes an electric motor M which is mounted to the frame of the apparatus beneath the rear cover plate, and which includes an output drive pulley 43. The drive system further includes drive pulleys 44 fixedly mounted on each of the two transverse rods 18A and 18B, and an endless drive belt 46 entrained about the three drive pulleys. Also, a follower pulley 48 is provided which engages the belt at a location between the pulleys 43 and 44 to ensure proper and firm engagement therewith.

Figure 6:
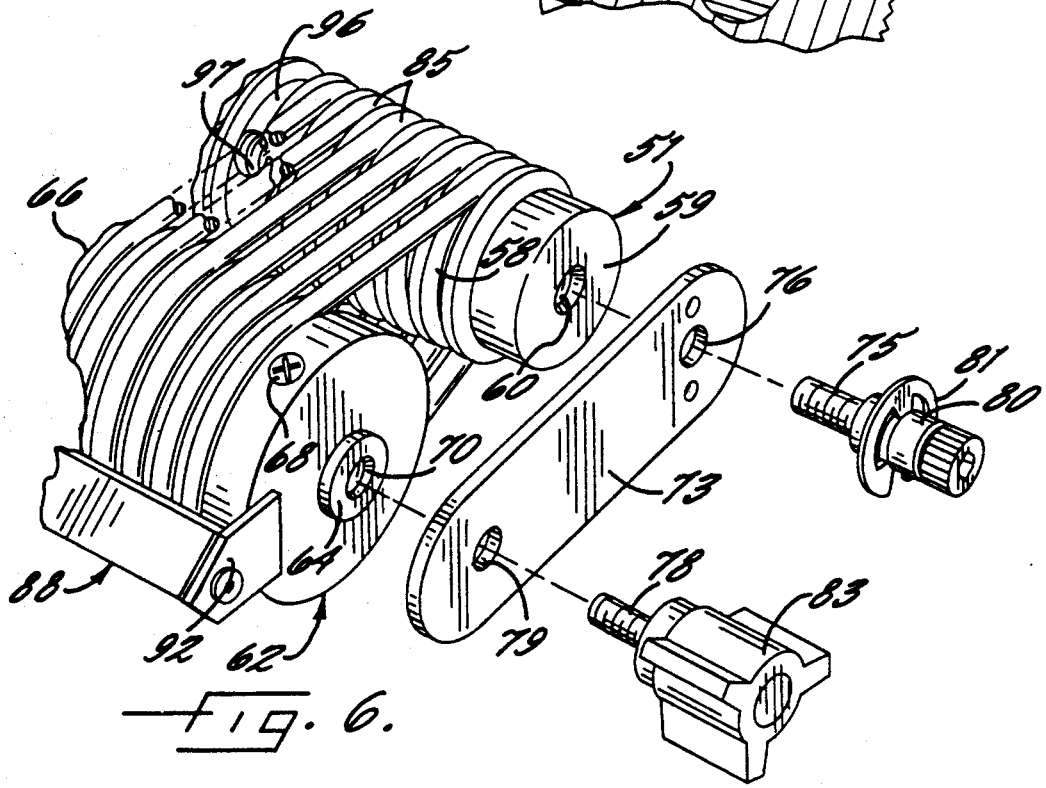
FIG. 6 is a fragmentary exploded view of the gate forming member.

The apparatus 10 further includes a stationary gate forming member 50 positioned above the upper runs of the three belts, and adjacent the forward side of the stack of sheets, and so as to define a nip 52 between the gate forming member 50 and the upper runs of the belts 30 and the forward drive rollers 33 on the rod 18A. In the illustrated embodiment, the gate forming member comprises a generally cylindrical first roll 51 defining a central axis 54 (FIG. 5) and an outer peripheral surface 56 which is concentric to the central axis 54. Also, the roll 51 has a plurality of annular grooves 58 extending about the circumference thereof, with the grooves being disposed about a second axis 57 which is parallel to and offset from the central axis in a direction parallel to the forward direction. Thus the grooves 58 are relatively deep along the half of the peripheral surface facing the stack of sheets S, and relatively shallow along the opposite half of the peripheral surface. Also, a transition between the two halves is located adjacent the nip 52, and the other transition is located diametrically opposite the nip. As best seen in FIG. 6, the first roll 51 further includes opposite ends 59, and each end 59 includes a threaded bore 60 which extends coaxially with respect to the axis 57.

Figure 3:
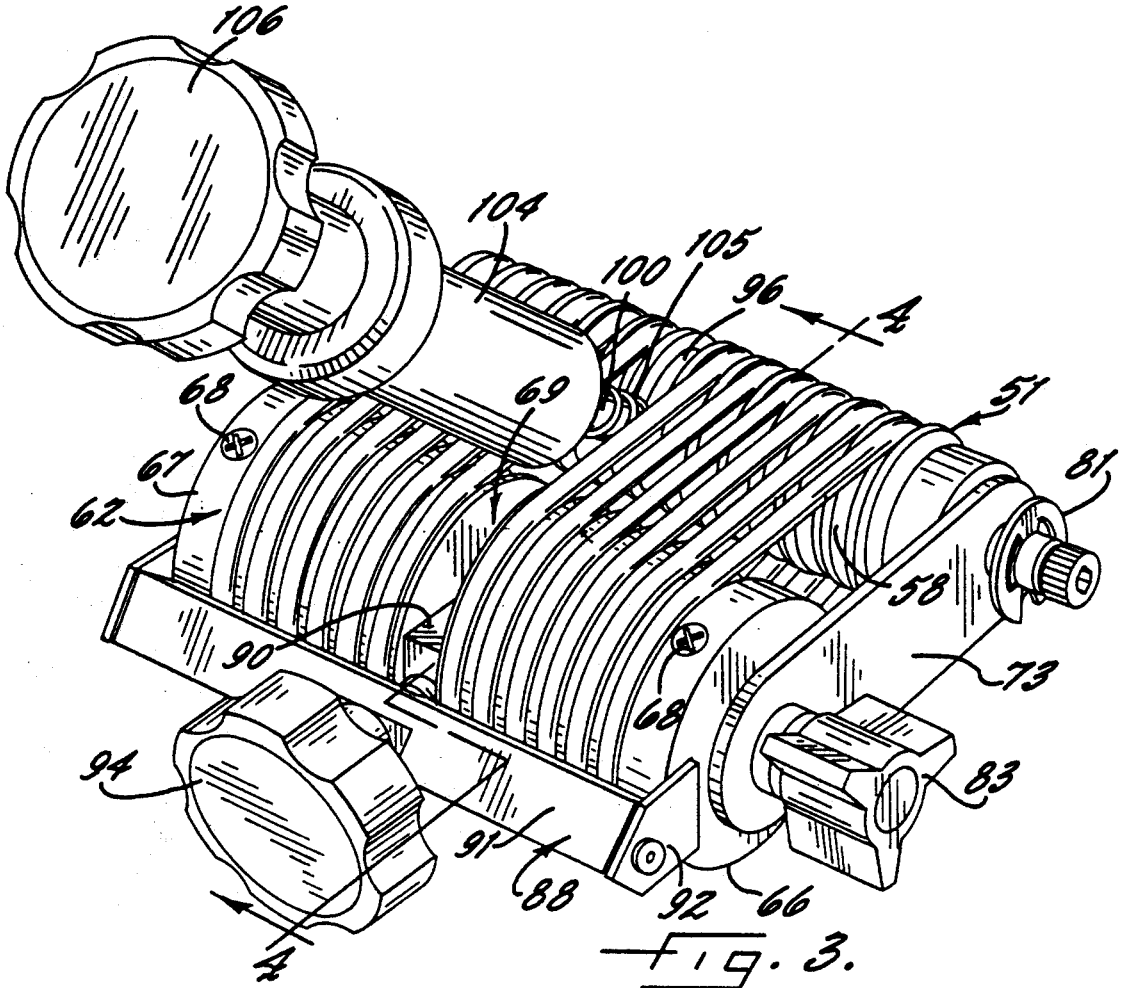
FIG. 3 is a perspective view of the gate forming member of the apparatus shown in FIGS. 1 and 2.

The gate forming member further comprises a generally cylindrical second roll 62, which defines a central axis 63 and which comprises a central shaft 64 (FIGS. 5 and 6) and a pair of sleeves 66, 67 (FIG. 3)coaxially mounted on the shaft 64. Each sleeve 66, 67 is locked to the shaft 64 by a radial set screw 68, and the sleeves 66, 67 are axially spaced apart to define a central space 69 therebetween. Also, each end of the central shaft 64 includes a threaded bore 70 for the purposes described below, and the peripheral surfaces of the sleeves 66,67 include a plurality of annular grooves 71 extending about the circumference thereof.

The first and second rolls are mounted to each other by means of a pair of bracket plates 73, and such that the opposite ends 59 of the first roll 51 are laterally aligned with respective ones of the opposite ends of the shaft 64 of the second roll 62. A first threaded member 75 extends through an opening 76 in each plate to threadedly engage the adjacent bore 60 in the first roll, and a second threaded member 78 extends through an opening 79 in each plate 73 to threadedly engage the adjacent bore 70 in the central shaft 64 of the second roll. The first threaded member 75 includes a sleeve 80 positioned externally of the plate for the purposes described below, and each sleeve mounts a C-shaped snap ring 81. In normal operation, the first threaded members 75 are tightened sufficiently so as to preclude relative rotation of the first roll 51 with respect to the bracket plates 73. Each of the second threaded members 78 includes an enlarged head 83 to facilitate manual rotation, and relative rotation of the second roll 62 with respect to the bracket plates 73 may be selectively controlled by the tightness of the second threaded members 78. In other words, upon manually loosening of the threaded members 78, the second roll 62 may be rotated about its central axis 63, and upon tightening of the second threaded members 78, such rotation is precluded.

In the assembled relationship of the first and second rolls, the rolls are disposed in an adjacent parallel relationship and with the annular grooves 58,71 of the first and second rolls being respectively aligned. Further, a ring 85 of elastomeric material is mounted in each pair of aligned grooves, and so as to be disposed along an endless path which encompasses the peripheral surfaces of the first and second rolls. The rings 85 are sized so as to lie radially inside of the peripheral surface of the first roll about the side facing the stack of sheets, and the rings 85 extend slightly beyond the peripheral surface at the nip, note FIG. 5. At a location diametrically opposite the nip, the rings lie within the periphery of the roll and they remain within the periphery along the side facing the stack of sheets.

The gate forming member 50 further comprises locking means 88 mounted on the second roll 62 for selectively engaging the rings 85 so as to prevent movement of the rings along their respective grooves in the second roll during rotation of the second roll about its central axis. This locking means 88 comprises a post 90 rotatably mounted on the central shaft 64 in the space 69 between the two sleeves 66,67, and a locking bar 91 positioned to extend transversely across the peripheral surface of the second roll in a direction parallel to the central axis 63. Each end of the bar 91 mounts a tab 92, which is positioned to overlie the end of the adjacent sleeve 66 or 67, and thereby stabilize the bar and prevent movement thereof in the axial direction. Also, a threaded member 93 having an enlarged knob 94 on its outer end interconnects the bar to the post. Thus upon manual rotation of the threaded member 93 in a direction to permit the bar 91 to move radially away from the roll 62 and the rings 85, the bar then may be freely moved along the circumference of the second roll. Upon rotation of the threaded member 93 so as to draw the bar radially toward the roll 62, the bar 91 is drawn radially into engagement with the rings 85 on the second roll to thereby prevent movement of the rings relative to the grooves 71 of the second roll during rotation of the second roll.

The apparatus 10 further includes means for mounting the roll 51 so as to permit the dimension of the nip 52 between the roll and endless belts 30 and rollers 33 to be adjusted. The ability to adjust the nip allows for the single feeding of various thicknesses of sheets. More particularly, the roll 51 includes a central portion 96 which does not include the grooves and rings, and a threaded radial opening 97 which extends into the central portion, note FIG. 6. Also, the sleeves 80 on the threaded members 75 define coaxial mounting posts, which are received within respective ones of the vertically extending slots 98 in the sides 25 of the front support plate 26. A threaded rod 100 is threadedly received in the opening 97 in the central position 96, and the threaded rod 100 includes an upper portion which extends through the slot **23*a* in the mounting bracket 23. This upper end portion is formed with an internally threaded axial bore, and a sleeve 104 and a spring 105 coaxially surround the rod below the mounting bracket 23, with the sleeve having an upper end which engages the underside of the bracket 23. The spring is under compression, so as to bias the roll 51 downwardly with respect to the bracket. This downward movement is limited by a control knob 106 which has a threaded member engaged in the bore at the upper portion of the rod 100, and an outer concentric sleeve for engaging the upper side of the mounting bracket. Thus rotation of the control knob 106 tends to raise or lower the roll with respect to the bracket, and to thus change the vertical dimension of the gap at the nip 52 formed between the roll 51 and the endless belts 30 and rollers 33. Also, the spring 105** will be seen to bias the roll toward the nip and it permits limited upward movement of the roll away from the nip and against the force of the spring.

The above-described mounting means for the roll 51 also permits the quick release and removal of the roll assembly which includes the roll 51, rod 100, sleeve 104, and control knob 106, to thereby facilitate replacement or rotational adjustment of the rings 85 as described above. More particularly, the assembly may be released and removed by lifting the roll 51 so that the mounting posts defined by the sleeves 80 are removed from the slots 98 in the sides 25 of the plate 26, and then slipped forward from the slot **23*a***.

The apparatus 10 further comprises sheet guide means positioned downstream of and in registry with the nip for guiding the sheets forwardly after advancing through the nip. This sheet guide means, as best seen in FIGS. 1 and 2, comprises two laterally spaced apart guide roller segments 110 which are mounted for rotation about the transverse rod 112, which is disposed parallel to the axes of the rods 18A and 18B. The upper portions of the guide roller segments are substantially coplanar with the upper run of the three endless belts 30, and a transmission is provided for operatively connecting the drive motor with the guide roller segments, so that the guide roller segments rotate at a peripheral speed corresponding to the speed of the three endless belts 30 and rollers 33. This transmission comprises a pair of guide belts 113 entrained about each support roll segment and the adjacent roller 33 with the guide belts having an upper run which is substantially coplanar with the upper runs of the three endless belts.

The sheet guide means further comprises a pair of clamping roller segments 115, which are mounted on a support rod 116 which is positioned along an axis parallel to the axis of the guide roller segments 110 so that the clamping roller segments rest upon the peripheral surface of respective ones the guide roller segments. The clamping roller segments are freely rotatable, and the rod is supported by means of a pair of lever arms 117 which are pivotally mounted on respective ones of the mounting posts defined by the sleeves 80, as best seen in FIG. 1, and so that the clamping roller segments rest from their own weight upon the guide roller segments 110.

To assist in properly delivering the sheets onto the conveyor belt B, at least one sheet guiding member 119 is positioned downstream of the nip and downstream of the sheet guiding means as seen in FIG. 1. The sheet guiding member is fixedly mounted above the conveyor belt, and it includes a downwardly inclined surface portion 120 for engaging the leading edge of each sheet and guiding the same towards an oscillating gripper 121 of conventional design. More particularly, the gripper is programmed to oscillate toward the clamping roller segments to engage the leading edge of each sheet, and then oscillate rearwardly while engaging the leading edge and so as to accurately position the sheet on the conveyor belt B.

A photocell 122 is mounted on the apparatus to control the operation thereof. More particularly, in one possible mode of operation, when no sheet is detected by the photocell, the motor is actuated so as to rotate the endless belts 30 and drive rollers 33 a controlled distance which is calculated to deliver a single sheet through the nip. Concurrently, the gripper 121 is oscillated toward the apparatus to catch the leading edge of the sheet, and then oscillate rearwardly to its release position. The advancing sheet is detected by the photocell 122, which holds the motor deactivated until the sheet is moved by the conveyor beyond the site of the photocell. The sequence is then repeated to deliver another sheet from the stack onto the conveyor belt.

Alternatively, the illustrated embodiment of the apparatus can be operated in a continuous fashion without the photocell or only using the photocell as a counter. In this mode, the speed of the drive means 42 and the conveyor belt B speed must be coordinated so that sheets fall on the belt at desired intervals.

During the sheet feeding operation, it is preferred that the gap formed at the nip 52 be adjusted such that the lowermost sheet of the stack is free to pass through the nip 52 without engaging the rings 85 and thus without significant frictional resistance, while the sheet immediately above the lowermost sheet engages the rings 85 at the nip and is retarded by the increased frictional resistance provided by the rings. Thus the sheets above the lowermost sheet are held substantially stationary in the stack. Also, the rear support member 34 is positioned so as to lift the rear side of the stack from the upper run of the three endless belts 30 and rollers 33 such that the sheets in the stack above the lowermost sheet will only contact the upper run after the lowermost sheet has entered the nip. Thus the sheets are reliably fed in a serial manner from the bottom of the stack and until all of the sheets in the stack have been delivered onto the conveyor belt B.

The apparatus may also be operated to provide for the shingling of the sheets being fed. In this regard, it will be understood that the peripheral surface on the side of the roll 51 facing the stack is smooth so as to offer very little resistance as the sheets form around the surface and are guided to the nip 52. The nip is adjusted to allow the lowermost sheet to freely pass between the rings 85 and the lower drive belt 30 and rollers 33. The second sheet which is immediately above the lowermost sheet meets the resistance of the rings 85 at the nip and is held in place until the lower sheet has fed out enough to allow contact with the underlying drive belt system which then drives the second sheet forward into a tight fit in the nip. The trailing edge of the lowermost sheet passes the nip and the second sheet continues to drive forward, thus allowing shingling. This system makes this feeder very tolerant of open edge leading products and slick sheets.

For shingling, the distance of the rings 85 from the drive rollers 33 is preferably about one and one-half times the thickness of the paper being fed. The rings thus retard the overlying second sheet while having minimum contact with the underlying first sheet.

Figure 4A:
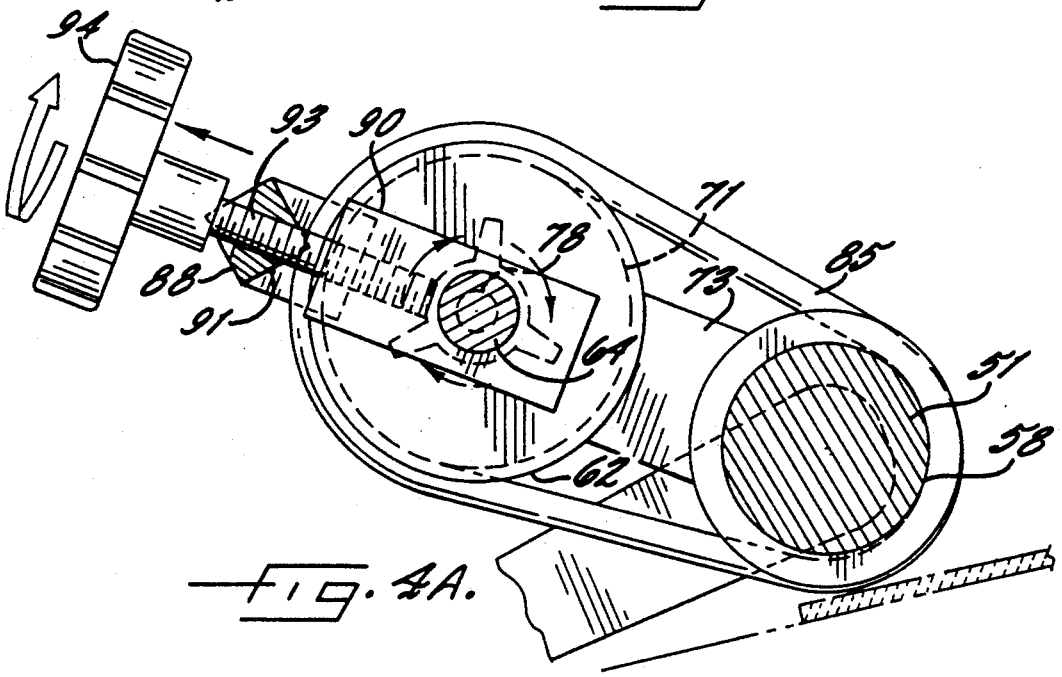
FIGS. 4A–4D are fragmentary side elevation views illustrating the steps involved in advancing the rings about the two rolls of the gate forming member.
Figure 4B:
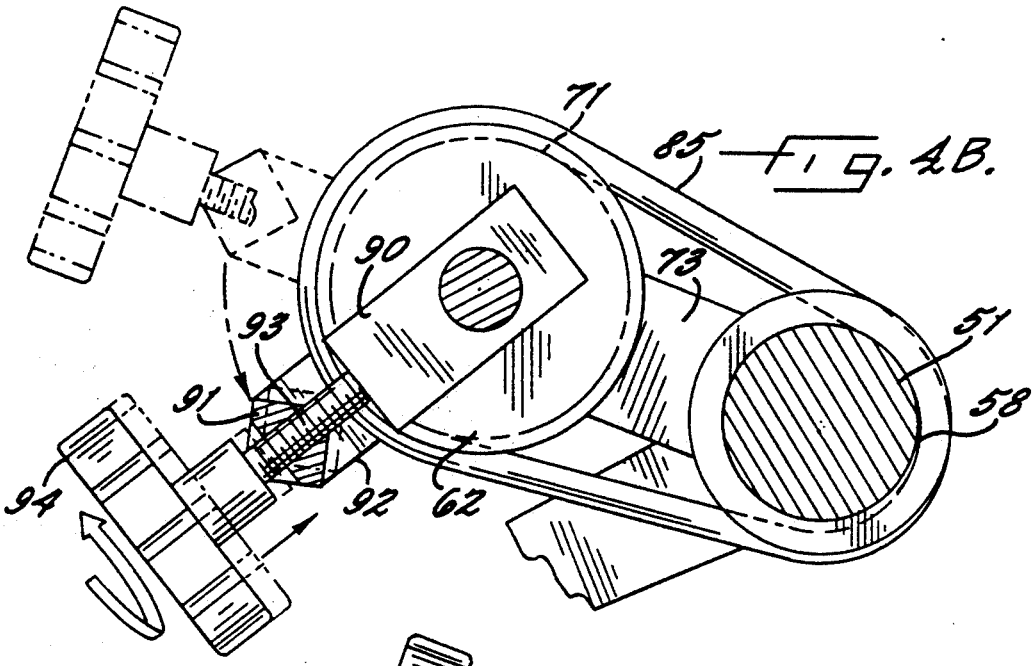
Figure 4C:
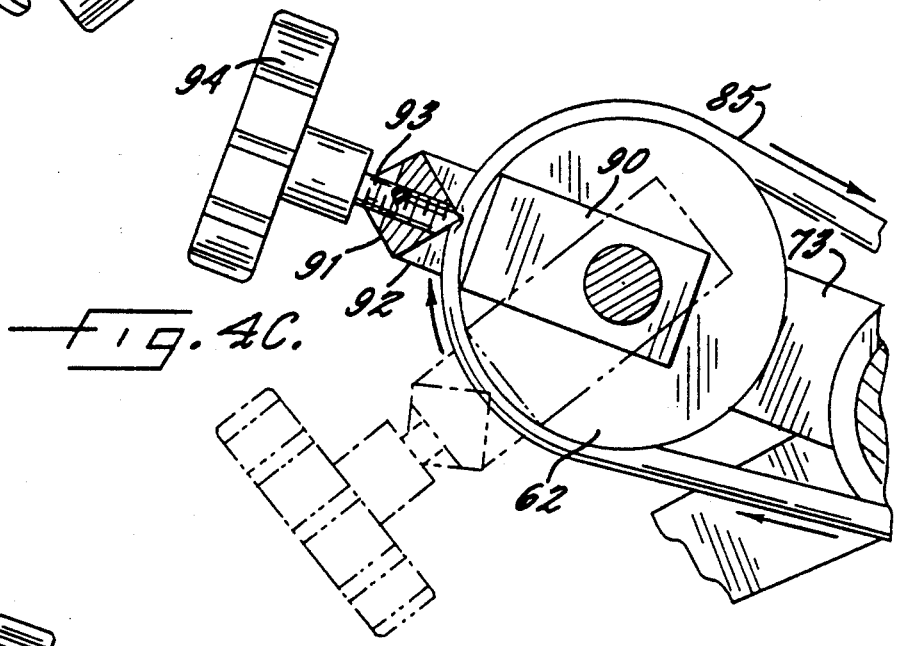
Figure 4D:
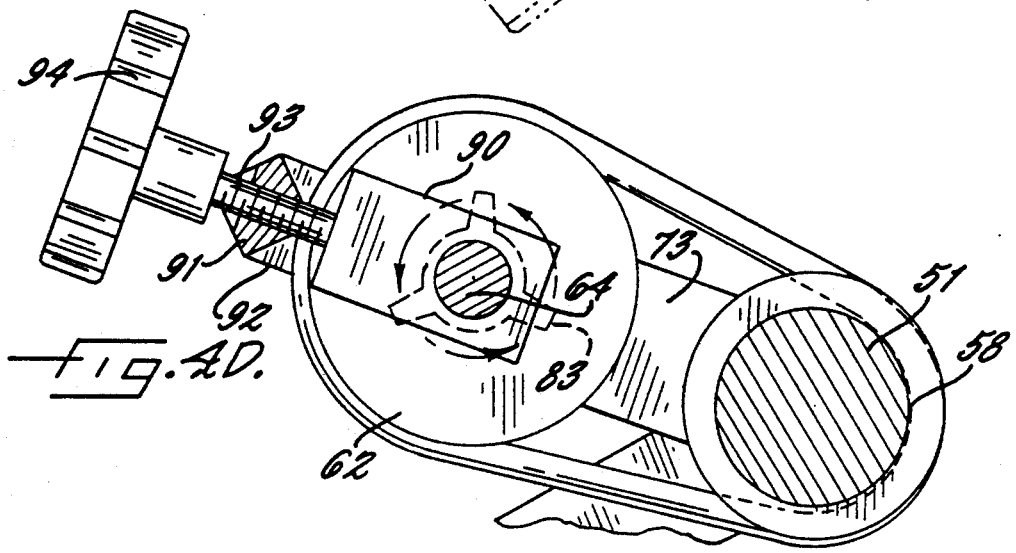

It will be apparent that the contact between the advancing sheets and the elastomeric rings 85 at the nip will in time cause the rings to wear and become less effective. In accordance with the present invention, the rings 85 may be easily rotated to position an unworn portion of each ring at the nip. The procedure for effecting such rotation is illustrated in FIGS. 4A–4D. Specifically, and as illustrated in FIG. 4A, the threaded members 78 are initially loosened by rotation of the knob 94 so as to permit the second roll 62 to rotate about its central axis. Next, the threaded member 93 is loosened so that the bar 91 may be drawn radially outwardly from the rings 85. The bar 91 is then moved downwardly to the position shown in FIG. 4B, and the threaded member 93 is re-tightened so that the bar engages the rings. The threaded member 93 and bar 91 are then lifted to the position of FIG. 4C, which causes the second roll 62 and rings 85 to concurrently rotate. The first roll 51 is locked against rotation by the tightness of the threaded members 75, and thus the rings slide along the grooves 58 in the first roll to bring a fresh unworn portion to the nip. As the final step, the threaded members 78 are retightened as shown in FIG. 4D, so that the second roll 62 is no longer free to rotate.

In the drawings and specification, there has been set forth a preferred embodiment of the invention, and although specific terms are employed, they are used in a generic and descriptive sense only and not for purposes of limitation.

That which is claimed is:

1. A gate forming member for use with an apparatus for serially feeding sheets from the bottom of a generally vertical stack of such sheets comprising a generally cylindrical first roll defining a central axis and including an outer peripheral surface, and a plurality of annular grooves extending about the circumference of said peripheral surface, a generally cylindrical second roll defining a central axis and including an outer peripheral surface, and a plurality of annular grooves extending about the circumference of said peripheral surface of said second roll, means mounting said first and second rolls in an adjacent parallel relationship and with said annular grooves of said first and second rolls being respectively aligned, such that the second roll may be selectively rotated about its central axis, and while said first roll is not rotatable about its central axis, said means mounting said first and second rolls including a threaded radial opening positioned at a central location along the length of said first roll for mounting said gate forming member to a sheet feeding apparatus, and a ring of elastomeric material mounted in each pair of aligned grooves and so as to be disposed along an endless path which encompasses the peripheral surfaces of said first and second rolls, whereby rotation of said second roll about its central axis facilities movement of said rings along said endless path about the peripheral surfaces of said first and second rolls, with said rings moving relative to the peripheral surface of said first roll.

2. The gate forming member as defined in claim 1 wherein said means mounting said first and second rolls further comprises a rod threadedly engaging said threaded radial opening and such that said rod extends radially from said first roll and is spaced from said second roll.

3. The gate forming member as defined in claim 1 wherein said second roll has a diameter greater than that of said first roll.

4. The gate forming member as defined in claim 1 wherein said annular grooves of said first roll are disposed concentrically about a further axis which is parallel to and offset from said central axis of said first roll and so that each groove of said first roll is relatively deep along the side thereof opposite said second roll and relatively shallow along the side thereof adjacent said second roll.

5. The gate forming member as defined in claim 4 further comprising locking means mounted on said second roll for selectively engaging said rings so as to prevent movement of said rings along their respective grooves in said second roll during rotation of said second roll about its central axis.

6. A gate forming member for use with an apparatus for serially feeding sheets from the bottom of a generally vertical stack of such sheets comprising a generally cylindrical first roll defining a central axis and including an outer peripheral surface, and a plurality of annular grooves extending about the circumference of said peripheral surface, a generally cylindrical second roll defining a central axis and including an outer peripheral surface, and a plurality of annular grooves extending about the circumference of said peripheral surface of said second roll, means mounting said first and second rolls in an adjacent parallel relationship and with said annular grooves of said first and second rolls being respectively aligned, and such that the second roll may be selectively rotated about its central axis, a ring of elastomeric material mounted in each pair of aligned grooves and so as to be disposed along an endless path which encompasses the peripheral surfaces of said first and second rolls, and locking means mounted on said second roll for selectively engaging said rings so as to prevent relative movement of said rings along said grooves of said second roll, whereby upon engagement of said locking means with said rings, rotation of said second roll about its central axis causes said rings to move along said grooves of said first roll.

7. The gate forming member as defined in claim 6 wherein said first and second rolls each have opposite ends, with the opposite ends of said first roll being laterally aligned respectively with the opposite ends of said second roll, and wherein said mounting means comprises a first bracket plate extending between one pair of the laterally aligned ends and a second bracket plate extending between the other pair of laterally aligned ends.

8. The gate forming member as defined in claim 7 wherein said second roll comprises a central shaft and at least one sleeve coaxially mounted on said shaft, and said mounting means further comprises means supporting said central shaft between said first and second bracket plates.

9. The gate forming member as defined in claim 8 said locking means comprises a post rotatably mounted on said central shaft, a locking bar positioned to extend transversely across said peripheral surface of said second roll in a direction parallel to its central axis, and threaded means interconnecting said bar to said post so that said bar may be selectively moved between a first position wherein said bar is radially spaced from said rings and said bar may be freely moved along the circumference of said second roll, and a second position wherein said bar is drawn radially into engagement with said rings on said second roll to thereby prevent movement of said rings relative to said grooves of said second roll during rotation of said second roll.

10. The gate forming member as defined in claim 9 wherein said second roll comprises a pair of said sleeves rotatably mounted on said shaft, with said post of said locking means being positioned between said pair of sleeves.

11. The gate forming member as defined in claim 10 wherein said means supporting said central shaft between said first and second bracket plates includes means for selectively securing said central shaft so as to prevent the rotation of said central interconnecting each of said pair of sleeves to said central shaft so as to preclude relative rotation therebetween.

12. The gate forming member as defined in claim 6 said means mounting said first and second rolls includes means mounting said first roll so as to preclude rotation of said first roll about its central axis.

13. The gate forming member as defined in claim 12 wherein said annular grooves of said first roll are disposed concentrically about a further axis which is parallel to and offset from said central axis of said first roll and so that each groove of said first roll is relatively deep along the side thereof opposite said second roll and relatively shallow along the side thereof adjacent said second roll.

14. An apparatus for serially feeding sheets in a forward direction from the bottom of a generally vertical stack of such sheets and comprising a frame, means mounted to said frame for supporting the generally vertical stack of sheets and so that the stack defines a forward side composed of aligned forward edges of the sheets, and a bottom, supporting means including endless belt means and means rotatably mounting said endless belt means so as to have an upper run positioned to extend across the bottom of said stack, drive means for rotating said endless belt means so that said upper run moves in a forward direction, a gate forming member mounted to said frame and comprising (a) a generally cylindrical first roll defining a central axis and including an outer peripheral surface, and a plurality of annular grooves extending about the circumference of said peripheral surface, and with said first roll positioned adjacent the forward side of said stack and so as to define a nip which forms a gap between said first roll and said upper run for permitting the lowermost sheet of the stack to pass forwardly from the stack through said nip, (b) a generally cylindrical second roll defining a central axis and including an outer peripheral surface, and a plurality of annular grooves extending about the circumference of said peripheral surface of said second roll, (c) means mounting said first and second rolls in an adjacent parallel relationship, with said second roll positioned on the side of said first roll opposite said forward side of said stack, and with said annular grooves of said first and second rolls being respectively aligned, and such that the second roll may be selectively rotated about its central axis, and (d) a ring of elastomeric material mounted in each pair of aligned grooves and so as to be disposed along an endless path which encompasses the peripheral surfaces of said first and second rolls, whereby rotation of said second roll about its central axis facilitates movement of said rings along said endless path about the peripheral surfaces of said first and second rolls, and means adjustably mounting said gate forming member so as to permit the dimension of said nip to be adjusted and such that said gate forming member may be readily removed from the remainder of said apparatus.

15. The apparatus as defined in claim 14 wherein said frame includes a support bracket, which is positioned above said nip, and said means adjustably mounting said gate forming member comprises a rod fixed to said first roll at a central portion thereof and such that the rod extends radially upwardly from said nip, and means interconnecting said rod to said support bracket so as to permit limited movement therebetween and to permit the dimension of said nip to be adjusted, and spring biasing means surrounding said rod for biasing said first roll toward said nip and for permitting limited movement of said first roll away from said nip and against the force of said spring biasing means.

16. The apparatus as defined in claim 14 further comprising locking means mounted on said second roll for selectively engaging said rings so as to prevent movement of said rings along their respective grooves in said second roll during rotation of said second roll about its central axis.

17. The apparatus as defined in claim 16 wherein said locking means comprises a post mounted for rotation about said central axis of said second roll, a locking bar positioned to extend transversely across said peripheral surface of said second roll in a direction parallel to its central axis, and threaded means interconnecting said bar to said post so that said bar may be selectively moved between a first position wherein said bar is radially spaced from said rings and said bar may be freely moved along the circumference of said second roll, and a second position wherein said bar is drawn radially into engagement with said rings on said second roll to thereby prevent movement of said rings relative to said grooves of said second roll during rotation of said second roll.

18. The apparatus as defined in claim 14 wherein said means mounting said first and second rolls includes means precluding rotation of said first roll about its central axis, and said annular grooves of said first roll are disposed concentrically about a further axis which is parallel to and offset from said central axis of said first roll and so that each groove of said first roll is relatively deep along the side thereof which is adjacent said vertical stack of sheets and relatively shallow along the opposite side thereof.

19. A gate forming member for use with an apparatus for serially feeding sheets from the bottom of a generally vertical stack of such sheets comprising a generally cylindrical first roll defining a central axis and including an outer peripheral surface, and a plurality of annular grooves extending about the circumference of said peripheral surface, a generally cylindrical second roll defining a central axis and including an outer peripheral surface, and a plurality of annular grooves extending about the circumference of said peripheral surface of said second roll, said annular grooves of said first roll being disposed concentrically about a further axis which is parallel to and offset from said central axis of said first roll and so that each groove of said first roll is relatively deep along the side thereof opposite said second roll and relatively shallow along the side thereof adjacent said second roll, means mounting said first and second rolls in an adjacent parallel relationship and with said annular grooves of said first and second rolls being respectively aligned, and such that the second roll may be selectively rotated about its central axis, and while said first roll is not rotatable about its central axis, and a ring of elastomeric material mounted in each pair of aligned grooves and so as to be disposed along an endless path which encompasses the peripheral surfaces of said first and second rolls, whereby rotation of said second roll about its central axis facilities movement of said rings along said endless path about the peripheral surfaces of said first and second rolls, with said rings moving relative to the peripheral surface of said first roll.

20. The gate forming member as defined in claim 19 further comprising locking means mounted on said second roll for selectively engaging said rings so as to prevent movement of said rings along their respective grooves in said second roll during rotation of said second roll about its central axis.

* * * * *